US008708156B2

(12) United States Patent
Grumbach

(10) Patent No.: US 8,708,156 B2
(45) Date of Patent: Apr. 29, 2014

(54) DEVICE FOR SEPERATING CARDBOARD COMPONENTS

(75) Inventor: Udo Grumbach, Harsewinkel (DE)

(73) Assignee: Grumbach GmbH & Co., KG (DE)

( * ) Notice: Subject to any disclaimer, the term of this patent is extended or adjusted under 35 U.S.C. 154(b) by 88 days.

(21) Appl. No.: 13/311,642

(22) Filed: Dec. 6, 2011

(65) Prior Publication Data

US 2013/0140221 A1 Jun. 6, 2013

(51) Int. Cl.
*B07C 5/36* (2006.01)

(52) U.S. Cl.
USPC ..... 209/615; 209/616; 209/688; 209/930

(58) Field of Classification Search
USPC ..... 209/615, 616, 688, 699, 930
See application file for complete search history.

(56) References Cited

U.S. PATENT DOCUMENTS 1,153,381 A * 9/1915 Gudmundsen A. ..... 209/688
1,416,585 A * 5/1922 Stables ..... 209/688
2,246,851 A * 6/1941 Harvey ..... 209/688
3,024,903 A * 3/1962 Victor ..... 209/632
4,511,046 A * 4/1985 Walsh et al. ..... 209/539
6,866,152 B2 * 3/2005 Grumbach ..... 209/615

FOREIGN PATENT DOCUMENTS

EP 1291092 3/2003
EP 1785200 A1 * 5/2007

* cited by examiner

*Primary Examiner* — Luis A Gonzalez
(74) *Attorney, Agent, or Firm* — Bourque and Associates, PA

(57) ABSTRACT

A device for separating cardboard components from bulk waste paper features a sorting unit that includes a feed area (1) including a flexibly mounted support (5) on which the bulk waste paper is supplied to a receiving device (3) studded with spikes (2). The spikes (2) and the feed area (1) are designed such that the spikes (2) essentially skewer only the cardboard components of the bulk waste paper fed in the feed area (1) while any material that cannot be skewered may cause the support (5) to move downwardly upon application of a specified force and bypass the spikes (2). At least one of the spikes (2) is connected to a receiving device (3) such that it can be displaced when a prespecified force is encountered.

13 Claims, 3 Drawing Sheets

DEVICE FOR SEPERATING CARDBOARD COMPONENTS

TECHNICAL FIELD

The invention relates to a device for separating cardboard components from bulk waste paper and more particularly, to such a device having a support in the feed area that can deflect under predetermined pressure and one or more spikes that can also deflect under pressure.

BACKGROUND INFORMATION

A similar device is known from EP 1 291 092 B1, for example. The known device includes a roller having spikes arranged on its circumference. The bulk waste paper is fed to the device on a support element that exhibits free spaces into which the spikes can dip. When paper arrives in the area between spike and recess, the paper yields into the recess and is not picked up by the spike. More rigid material such as cardboard, however, is not pressed into a respective recess but is pierced by the spike and taken along by the roller. The material adhering to the spikes is then separated from the roller by a stripper.

In practical applications, it is possible for other objects to enter the bulk waste paper when waste paper is disposed. In particular when hard objects such as wood enter a sorting device using said method, the result is that the spikes break off from the roller or become damaged.

It is therefore the object of the invention to provide a device of the type mentioned above, where breaking off or damaging of the spikes can be avoided in such situations.

SUMMARY

The invention discloses a device for separating cardboard components from bulk waste paper. A sorting unit includes a feeding area on which the bulk waste paper is fed to a receiving device equipped with spikes. The feeding area is designed such that the spikes essentially skewer only the cardboard components of the bulk waste paper fed into the feeding area. At least one of the spikes is connected to the receiving device such that it can be displaced upon application of a pre-specified force.

According to the invention, the spikes are flexible and/or are connected to the receiving device. If an object that is located in the bulk waste paper enters into the receiving device and can neither be deformed or displaced nor skewered by the spikes, then the spikes can yield upon contact with said object without being damaged due to their flexible connection. For this purpose, in addition to the spikes, the receiving device preferably exhibits protrusions that, contrary to the spikes, are rigid and not flexible, such that the spikes between the protrusions are protected by the protrusions upon contact with a hard object and thus cannot break off.

Further, the support on which the bulk waste paper is conveyed to the receiving device and on which the sorted cardboard components are picked up is preferably provided in a flexible design as well. A large object may for example pass under the receiving device due to a yielding of the support, without this object blocking the equipment or becoming wedged between the receiving device and the support.

BRIEF DESCRIPTION OF THE DRAWINGS

These and other features and advantages of the present invention will be better understood by reading the following detailed description, taken together with the drawings where in.

DETAILED DESCRIPTION OF THE PREFERRED EMBODIMENTS

Figures 1, 1A:
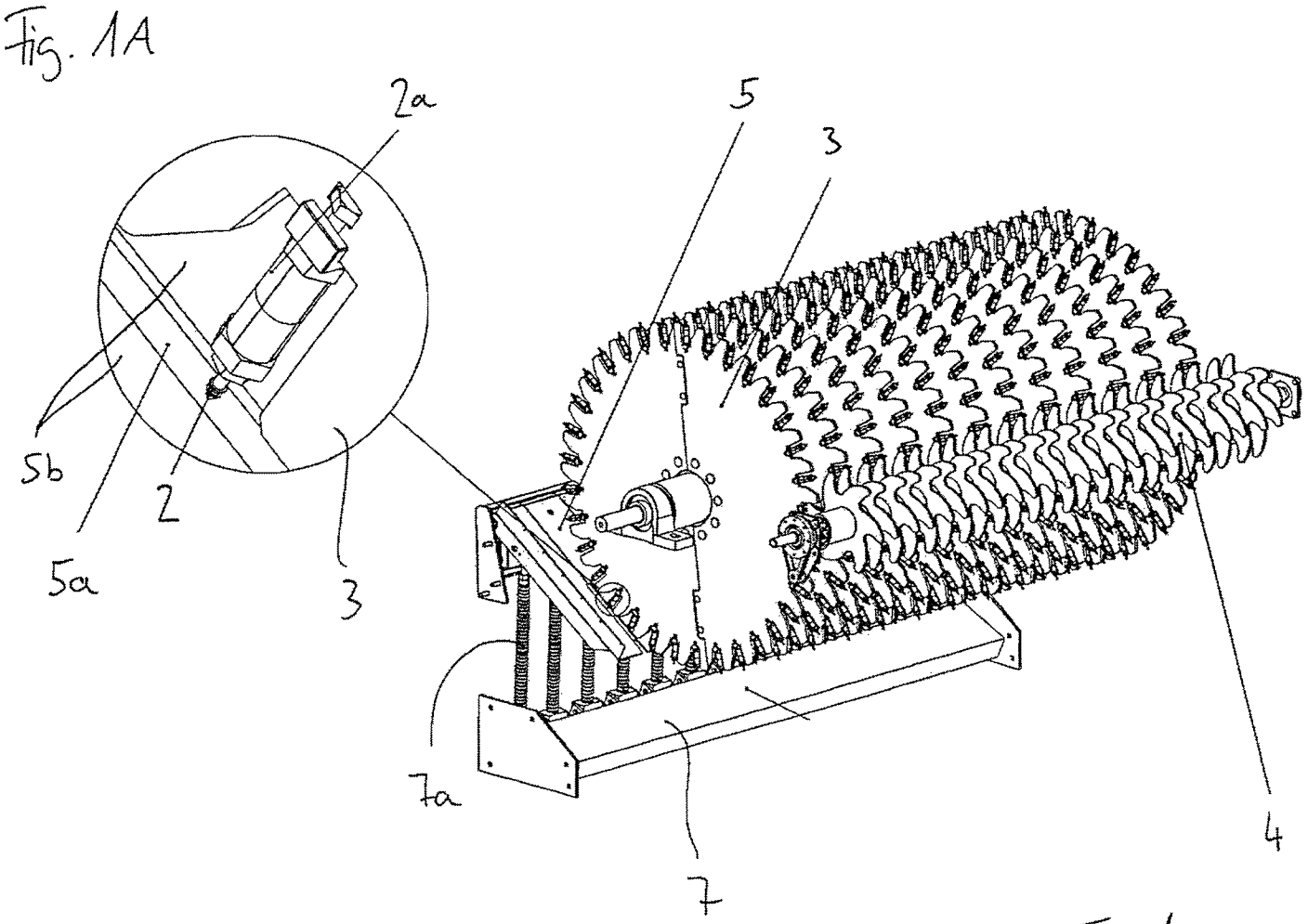
FIG. 1 shows a perspective view of a device according to the invention.
FIG. 1A shows an enlarged detail of the view of FIG. 1.

The device shown in FIGS. 1 and 1A or 2 and 2A, respectively, for separating cardboard components from bulk waste paper exhibits a sorting unit, which includes a feeding area 1 and a receiving device 2. At least one but preferably a plurality of disk-shaped receiving elements 3 serve as the receiving device. These, at their circumference, have radially protruding spikes 2 for skewering the cardboard components. In the example shown, the receiving elements 3 are supported rotatably parallel to each other and perpendicular to the feed direction of the bulk waste paper around a common rotational axis and form a roller-like receiving device. A stripping device 4 downstream serves the purpose of removing the skewered cardboard components from the roller 3.

According to the invention, the feeding area 1 is formed of a support 5, which can be comprised of one or more support elements 5*b*. Located in the support 5 are recesses 5*a* or depressions, into which the spikes 2 of the rotating receiving device 3 can dip, as is shown in FIG. 1A, for example. According to the invention, the support 5 is designed in such a way that it yields or deflects when a pre-specified amount of force acts upon it. Preferably, the force required for yielding is adjustable. In the example shown, a spring bar 7 with springs 7*a* attached to it is provided, said springs being compressed onto the support 5 at a pre-specified force thus generating an elastic restoring force, which pushes the support back to its original position when the acting force is reduced. The force to be preset for the springs 7*a* should be dimensioned such that the support 5 yields only little or not at all during "normal" operation, i.e., when skewering cardboard or pulling along paper. The flexibility of the support 5 has the effect that hard and especially thick objects that enter into bulk waste paper do not wedge between the support and the roller or damage components of the device. Instead, in this case the support 5 expands or moves downwards and the respective object can run through the system. The support 5 then springs back and no interruption of the running operation is required.

Figure 2:
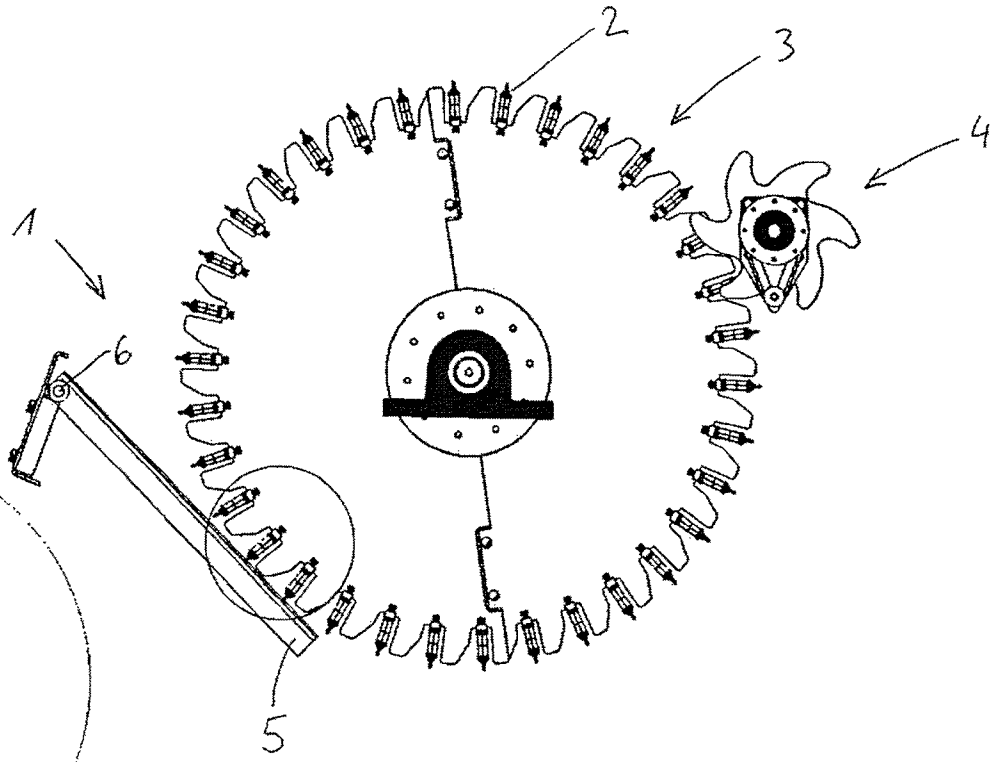
FIG. 2 shows a corresponding side view of the device according to the invention.
Figure 2A:
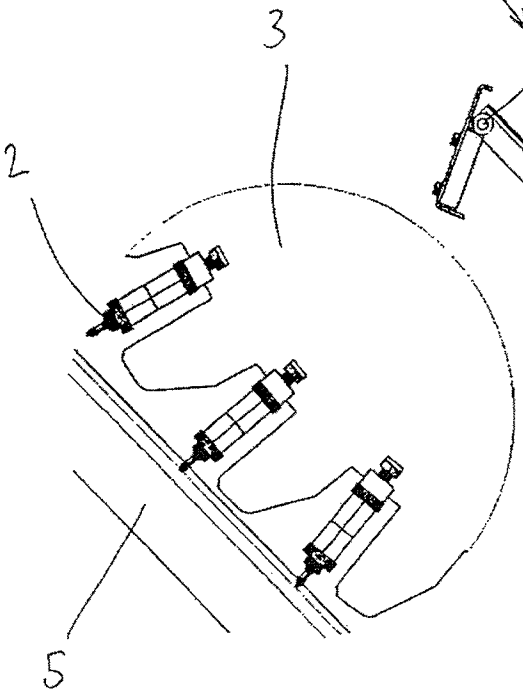
FIG. 2A shows an enlarged detail of FIG. 2.

The support 5 is preferably designed in the form of a slide sloped downward toward the receiving device 3, as shown in particular in FIGS. 1 and 2. The support, or the support elements 5, respectively, of the feeding device are supported in a pivoting manner around an axis 6 at the side pointing away from the receiving device 3, such that the support 5 in the case described above pivots away from the receiving device in the event that thick or non-skewerable objects such as pieces of wood or catalogs or the like are supplied, allowing these objects to run through the system without the need to power down the system or without causing an operational stop.

Figure 3A:
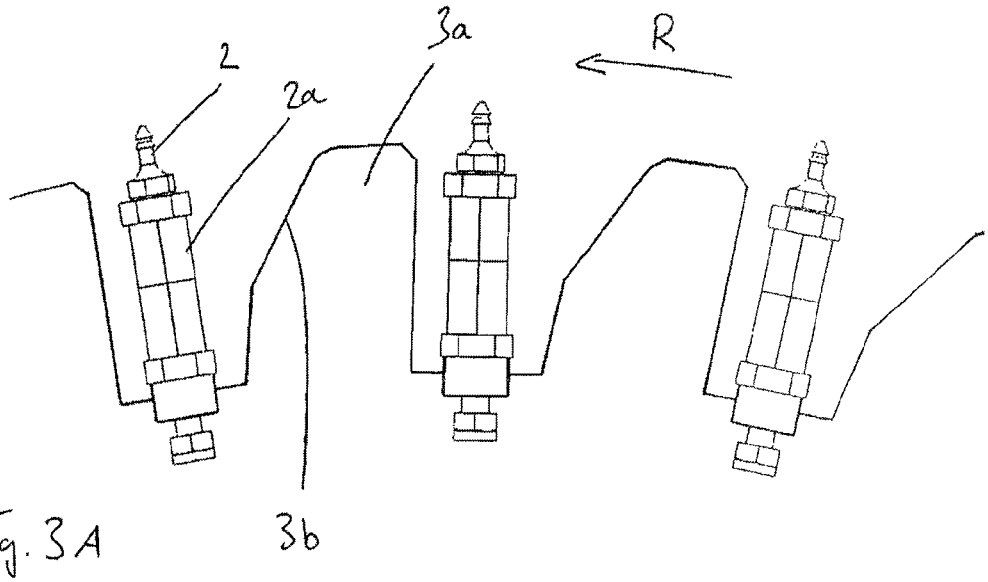
FIG. 3A shows an enlarged detail of a section of the receiving device with spikes in a first position.
Figure 3B:
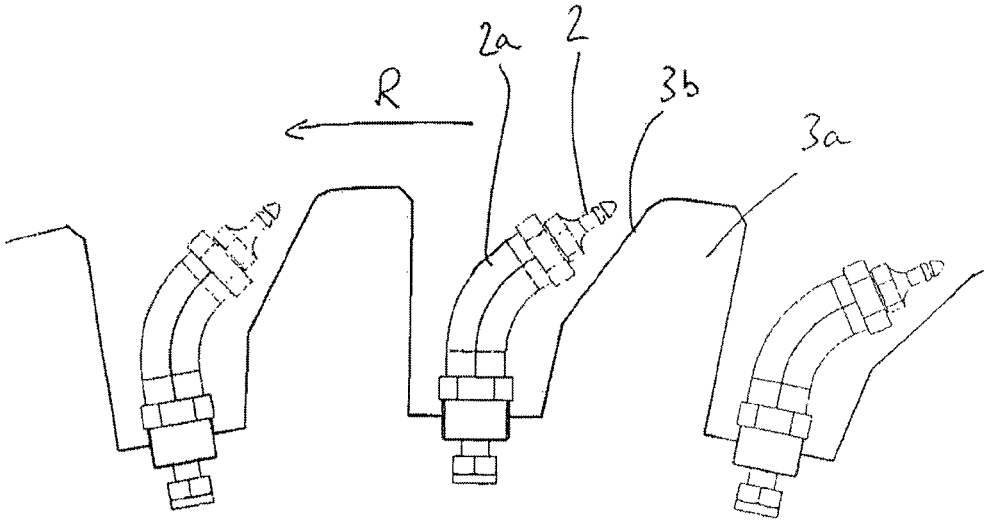
FIG. 3B shows an enlarged detail of a section of the receiving device with spikes in a second position.

To prevent the spikes 2 from breaking in the situations mentioned, they are protected according to the invention by being attached to the receiving device such that they can avoid the effect of the force, for example when they contact an object that cannot be skewered. To this end, the spikes 2 are connected flexibly to the receiving device 3 as shown in FIGS. 3A and 3B. Flexible means that when a force is encountered, the spikes can move from a regular position shown in FIG. 3A into an avoidance position shown in FIG. 3B. For this purpose, the spike 2 can be attached to the receiving device via a connection element 2*a* that is flexible in this sense (e.g., made of rubber, another flexible material or in the form of a spring or in the form of a joint or the like). In addition to the spikes 2, protrusions 3*a* that have a protective function are provided between the spikes 2. In the regular position of the spikes 2 shown in FIG. 3A, the tips of said spikes extend beyond the outer edge of the adjacent protrusions 3*a*. The magnification of the detail shown in FIGS. 3A and 3B shows one exemplary embodiment in which the receiving device 3 is made of rotatably supported disk-shaped elements; the arrow R indicates the direction of rotation of the receiving roller 3.

If in the course of system operation a spike 2 now contacts a non-skewerable object, the spike will be displaced flexibly due to the effects of the force and on account of the flexible connection, which is shown in FIG. 3B. For this purpose, the protrusions exhibit a displacement space into which the spike can dip when a force is encountered. Preferably, the protrusions are chamfered or provided with recesses for this purpose. In the shown example, the side of the protrusion 3*a* that is running ahead in the direction of rotation R is chamfered. The displacement space is dimensioned such that the spike with its tip is located fully between adjacent protrusions 3*a* and no longer extends beyond the protrusions as is the case in the regular position shown in FIG. 3. As a result, the spike 2 is protected and when the receiving device 3 contacts a hard or not skewerable object, it essentially comes in contact only with the protrusions 3*a*. However, the protrusions are essentially built much stronger such that they are not damaged by said object. If a flexible support is provided as described above (which is not obligatory), then the receiving device 3 will press against the respective object via the protrusions, which in turn causes a force to be applied on the support, which will yield eventually, such that the non-skewerable object can pass through the device without damaging the spikes 2. Preferably, the connection element 2*a* for the spikes 2 is designed elastically such that the spikes 2 will return to their regular position after the displacement due to the effects of the force.

Modifications and substitutions by one of ordinary skill in the art are considered to be within the scope of the present invention, which is not to be limited except by the allowed claims and their legal equivalents.

The invention claimed is:

1. A device for separating cardboard components from bulk waste paper, having a sorting unit which includes a feeding area (1), on which the bulk waste paper is fed to a receiving device (3) equipped with spikes (2) and the feeding area (1) is designed such that the spikes (2) essentially skewer only the cardboard components of the bulk waste paper fed into the feeding area (1), characterized in that at least one of the spikes (2) is connected to the receiving device (3) such that at least one of the spikes can be displaced upon application of a prespecified force and wherein a connection element (2*a*) is provided for connecting purposes, where said connection element (2*a*) is designed such that the connection element is essentially rigid when a force is applied in the longitudinal direction of the spike (2) and essentially flexible if the force is applied in other directions.

2. The device as set forth in claim 1, characterized in that the feeding area (1) includes a support (5) on which the bulk waste paper can be fed to the receiving device (3) and that is designed such that the spikes (2) can penetrate the support (5) at least in part and wherein the support (5) yields upon pressure.

3. The device as set forth in claim 2, characterized in that the support 5 includes a plurality of support elements (5) that are essentially arranged parallel to one another and perpendicular to a feed direction of the bulk waste paper with said elements being supported such that they are displaced upon pressure.

4. The device as set forth in claim 2, characterized in that the support (5) is supported in a pivoting manner.

5. The device as set forth in claim 4, characterized in that the pivoting support is provided at an end of the support element (5) that is located away from the receiving device (3).

6. The device as set forth in claim 2, characterized in that the support element (5) is designed such that is springs back when the pressure subsides.

7. The device as set forth in claim 1, characterized in that the receiving device exhibits at least one receiving element with spikes arranged on its circumference.

8. The device as set forth in claim 7, characterized in that protrusions (3*a*) are arranged between adjacent spikes (2) on the circumference of the receiving element.

9. The device as set forth in claim 8, characterized in that the spikes (2) protrude an amount greater than in relation to the protrusions (3*a*) of the receiving element.

10. The device as set forth in claim 8, characterized in that the protrusions (3*a*) are designed such that on at least one side the spike (2) can be displaced at a prespecified application of force so that due to a flexible connection the respective concerned spike (2) can be fully pushed behind an adjacent protrusions.

11. The device as set forth in claim 8, characterized in that the protrusions (3*a*) are chamfered for the purpose of creating a displacement space for the spikes (2).

12. The device as set forth in claim 7, characterized in that at least one receiving device (3) is provided that is supported in a rotatable manner perpendicular to the feed direction.

13. A device for separating cardboard components from bulk waste paper, having a sorting unit which includes a feeding area (1), on which the bulk waste paper is fed to a receiving device (3) equipped with spikes (2) and the feeding area (1) is designed such that the spikes (2) essentially skewer only the cardboard components of the bulk waste paper fed into the feeding area (1), characterized in that at least one of the spikes (2) is connected to the receiving device (3) such that at least one of the spikes can be displaced upon application of a prespecified force and wherein the feeding area (1) includes a support (5) on which the bulk waste paper can be fed to the receiving device (3) and that is designed such that the spikes (2) can penetrate the support (5) at least in part and wherein the support (5) yields upon pressure, and wherein the support (5) is supported in a pivoting manner.

* * * * *